US011577110B2

(12) United States Patent
Lovas

(10) Patent No.: US 11,577,110 B2
(45) Date of Patent: Feb. 14, 2023

(54) POST-FOAMING COMPOSITION FOR PROTECTION AGAINST FIRE AND/OR HEAT

(71) Applicant: Swiss Fire Protection Research & Development AG, Samen (CH)

(72) Inventor: Laszlo Lovas, God (HU)

(73) Assignee: SWISS FIRE PROTECTION RESEARCH & DEVELOPMENT AG, Sarnen (CH)

( * ) Notice: Subject to any disclaimer, the term of this patent is extended or adjusted under 35 U.S.C. 154(b) by 553 days.

(21) Appl. No.: 16/734,181

(22) Filed: Jan. 3, 2020

(65) Prior Publication Data

US 2020/0139180 A1 May 7, 2020

Related U.S. Application Data

(63) Continuation of application No. PCT/IB2017/054066, filed on Jul. 6, 2017.

(51) Int. Cl.
*A62D 1/02* (2006.01)
*A62D 1/06* (2006.01)

(52) U.S. Cl.
CPC ..... *A62D 1/0071* (2013.01); *A62D 1/06* (2013.01)

(58) Field of Classification Search
CPC ..... A62D 1/0071
See application file for complete search history.

(56) References Cited

U.S. PATENT DOCUMENTS

| | | | |
|---|---|---|---|
| 3,609,074 | A | 9/1971 | Rainaldi et al. |
| 3,656,553 | A | 4/1972 | Rainaldi et al. |

FOREIGN PATENT DOCUMENTS

| | | | |
|---|---|---|---|
| CA | 2115922 | A1 | 3/1993 |
| EP | 1561777 | A2 | 8/2005 |
| FR | 2078186 | A5 | 11/1971 |
| GB | 636938 | | 5/1950 |
| GB | 1349508 | A | 4/1974 |
| ZA | 200002234 | B | 11/2001 |

OTHER PUBLICATIONS

First Office Action for Chinese Application No. 201780094586.4 dated Nov. 4, 2020; Applicant: Swiss Fire Protection Research & Development AG.

Translation of First Office Action for Chinese Application No. 201780094586.4 dated Nov. 4, 2020; Applicant: Swiss Fire Protection Research & Development AG.

First Office Action for Eurasian Patent Application No. 202090202 dated May 31, 2021; Applicant: Swiss Fire Protection Research & Development AG.

Translation of First Office Action for Eurasian Patent Application No. 202090202 dated May 31, 2021; Applicant: Swiss Fire Protection Research & Development AG.

International Search Report and Written Opinion issued by the International Searching Authority dated Mar. 9, 2018 for corresponding International Patent Application No. PCT/IB2017/054066.

International Preliminary Report on Patentability issued by the International Bureau dated Aug. 23, 2019 for corresponding International Patent Application No. PCT/IB2017/054066.

Translation of FR2078186 A5 (filing date: Feb. 4, 1971) with a publication date of Nov. 5, 1971.

*Primary Examiner* — Peter F Godenschwager
(74) *Attorney, Agent, or Firm* — Owen G. Behrens; Paul Murty; Smith & Hopen, P.A.

(57) ABSTRACT

Inert and hydrocarbon gases, such as propellant gases, maintain a pressure in a bottle to ensure that a formed composition can be dispensed to an intended destination. The carrier releases soluble hydrocarbon gases and the water drops dissolve inert gases, so the liquid is inflated and creates upstanding foam. This foam maintains the texture and water content up to 6-24 hours, depending on the ratio of the fire-resistant component. As heat reaches the foam, the heat-resistant silicate component becomes activated. Strong heat causes evaporation of the moisture of the carrier, and then the bound water of the silicates evaporates from the foam, with a honeycomb-structure left behind which is a good thermal insulator and is able to protect the object. Above approximately 350° C., a ceramic protective layer forms, while the water content of the foam inside the foam migrates outwards towards the dry crust.

11 Claims, No Drawings

POST-FOAMING COMPOSITION FOR PROTECTION AGAINST FIRE AND/OR HEAT

CROSS-REFERENCE TO RELATED APPLICATIONS

This nonprovisional application is a continuation of and claims priority to international patent application No. PCT/IB2017/054066, entitled "Post-foaming composition for protection against fire and/or heat," filed Jul. 6, 2017 by the same inventor.

BACKGROUND OF THE INVENTION

The task of invention is an alkaline post-foaming composition for protection against fire and/or heat which contains inert gas as a propellant, 0.5-6% by weight, a fire-resistant ingredient up to 75% by weight, such as alkali and/or alkaline earth metal silicates, as well as solvent medium as water.

In order to preserve and protect the environment and human assets, as well as prevent or reduce damage, it is necessary to put out fires and protect against their heating effect. For fire extinguishing, many different materials and practices have already been known. For firefighting, in many cases, silicates, including sodium silicate substances, are used in fire extinguishant materials. For example, patent specification ZA200002234 presents a solution in which solid silicate belonging to the group of micas and vermiculites are used as flame-retardant powder. In use, the additive with the raw material forms carbonaceous precipitate, which is intumescent if exposed to heat and thus has heat insulating properties. In patent specification FR2078186, a composition became known, wherein an aqueous solution of sodium or potassium silicate is used to neutralize the fire. With these solutions, the use of silicates is favorable because they have heat-curing characteristics and thereby form a closed layer at the surface, increasing the flame-retardant effect. The disadvantage, however, is that the application of extinguish material on the target surface is difficult and even dangerous depending on the situation. The stability of conventional fire extinguishant foams is very low, and the consistency does not allow use on vertical surfaces.

A method is known in which the foam is formed of a mixture of liquid and gaseous components and is ejected in the same area or on the protected surface. After the dispensed material is mixed and foamed, the physical and/or chemical properties allows the ability to defend against the fire, and the combustible materials separates from the flames. For example, patent specification CA2115922 describes a foam obtained from concentrate by dilution with water, and a traditional foam formed by an air-foam nozzle. Such compositions, however, have some disadvantages. On the one part, the composition is expensive due to the raw materials, and on the second part, the well composed and applied foam is not sufficiently long-lasting. Moreover, on inclined surfaces, especially on the surfaces adjacent to vertical, the foam does not stick well, sliding down, and thus it does not able to protect the surface satisfactorily against fire. Accordingly, these foams are not suitable for thermal insulation in emergency.

U.S. Pat. No. 3,656,553 discloses a material mixture suitable for extinguishing fire that contains a silicate compound, a foam-generating component, and a gaseous substance. The gaseous substance facilitates the dispensing of the fire extinguishing material and its foaming at the extinguishing location. However, the significant disadvantage of this composition is that it contains the component dibromohexafluoropropane, which, when extinguishing fires, forms hazardous decomposition products—carbon oxides, hydrogen fluoride, hydrogen bromide—at temperatures above 200° C., and releases chemicals that are highly toxic when breathed in, meaning this composition is disadvantageous for use when extinguishing fires.

Another disadvantage of this composition is that while it is being prepared, after the silicates have been mixed in, the silicates start to gel as a result of the insufficient alkalinity of the pH value, and then precipitate, forming a solid precipitate in a short amount of time, which settles at the base of the storage unit. The reason for this is sodium (Na) silicates start to gel at a pH value under 11.5, and this process accelerates as the pH decreases. In the case of the given solution, the pH value of the mixed solution is around 10.9, which leads to the precipitation of the silicates over the course of 24 hours. As a result, the foam solution has to be used within approximately 1 hour of being mixed, so it cannot be stored, and due to this it is unsuitable for use as a fire extinguishing material that is periodically stirred and continuously stored in a built-in extinguishing system.

Another disadvantage of the given composition is that it collapses a short time after being dispensed, losing its liquid content, and after drying it becomes combustible, which is particularly dangerous when extinguishing extensive fires. Yet another disadvantage of the given composition is that when diluted, it loses its ability to generate foam, and so becomes unusable for extinguishing fires; additionally, due to the gelling of the silicates, it cannot be produced in the form of a concentrate. Moreover, the given solution is unsuitable for extinguishing fires of substances that have a higher boiling point than water, such as cooking oil fires, as it causes extreme splashing and boil-over.

U.S. Pat. No. 3,609,074 discloses a fire extinguishing material composition that contains the substance Halon 2402 ($C_2F_4Br_2$), also known as Dibromotetrafluoroethane. A disadvantage of this substance is that the Dibromotetrafluoroethane component damages the ozone layer. Moreover, the alkalinity of the components is insufficient to enable the use of a cheaply produced carbon steel storage tank without it having corrosion protection. In addition, as a result of the acidic pH, precipitate starts to form after the silicates have been mixed in, and so this version cannot be stored for a long time either. As a result of the substance's thixotropic feature, it hardens due to the effect of mixing, therefore it cannot be used as the fire extinguishing substance that is constantly stored and periodically mixed in a built-in extinguishing system. Also, the substance can only be slightly diluted and still remain effective. In the case of any greater dilution, up to 5 to 10 times, it completely loses its foam-forming ability. Therefore, it cannot be produced in the form of a concentrate and cannot be supplied in a thicker state.

Patent specification GB1349508 discloses a fire extinguishing material composition having a pH value of 5 to 9 and uses CFC (chlorofluorocarbon) gas as the propellant for dispensing the extinguishing material. CFC propellant gases damage the ozone layer, and so they may not be used legally. Moreover, at the recommended pH, the sodium silicate in the solution starts to gel after mixing has been performed. This fact, on the one part, prevents the solution from being supplied in the form of a concentrate for dilution. On the other part, the precipitation of the silicates in the solution forms sediment and causes blockages in the extinguishing pipework. Due to this fact, this composition is not suitable for use in a built-in instant foaming extinguishing system either. In addition, as a consequence of the contents of the composition, toxic decomposition products are produced due to the effect of heat, which cause increased danger for the persons participating in extinguishing fires. Moreover, as a consequence of the precipitation of the silicates, it cannot be produced as a concentrate and can only be slightly diluted. Therefore, it is difficult to transport.

The fire extinguishing composition disclosed in patent specification FR961899 contains the component methyl bromide and uses carbon dioxide as the propellant. The significant disadvantage of the given solution is that methyl bromide is an extremely dangerous toxin with neurological effects and is lethal if breathed in. In addition, it damages the ozone layer and further dangerous compounds are produced in the course of its thermal decomposition. The water-soluble carbon dioxide propellant gas also creates carbonic acid, which causes the silicates present in the foam solution to immediately precipitate. In addition, the saponin in the composition does not ensure the appropriate alkaline pH level in the solution so that the silicates remain in solution and prevent the creation of sediment; therefore, the precipitation of the silicates from the solution and the damaging effects originating from this cannot be avoided here either.

Patent specification EP1561777 relates to a reduced smoke-emitting polyurethane (PUR) foam, the fire-resistance of which is extremely low, it cannot be used as a fire extinguishing material for the production of fire-inhibiting coatings.

The aim of creating post-foaming composition according to the invention was to create a composition to overcome shortcomings of conventional materials made with known mechanism of action, with use of favorable-cost substances as ingredients, which can be readily prepared, and yet provide fire resistance, and durability on the surface, as well as a consistency appropriate to fight against fire or heat and provide a long-term thermal insulation and/or fire-retardant coating on the protected surface.

The invention of post-foaming composition is based on the recognition that, if a known good fire-resistant alkali metal or alkaline earth metal silicate solution is mixed into such foamable carrier material, which bonds it in its molecular structure, and is able to be added to water containing some dissolved inert gas, and if some further hydrocarbon gas can be captured and added to the solution, then such liquid and gas phase fire extinguishing and/or thermal insulation material can be created and stored in containers under pressure, which produces large volume firefighting foam upon dispensed, in the way of the inert gas dissolved in the water and the hydrocarbon gas in the carrier may expand on decrease of the ambient pressure—including the carrier and the fire-resistant components as the major volume of extinguishing foam—while the fire-resistant components in the carrier hardens by heat and forms a solid, porous, insulating, and heat-resistant material, to protect the surface from heat and fire.

Another part of the invention is that, according to the results of the investigation, certain appropriate molecular weight fatty acids, fatty alcohols, and their salts, amides, esters, and aldehydes as carriers on the one hand, are able to bond at molecular level to produce a gel-like stable structure. On the other hand, in special cases, they can be dissolved in water, and so, can form a solution with water, containing certain silicates and solved inert gas, to form a stable solution under pressure, the absorption of hydrocarbon gases in which carrier results in an increased expansion ratio, so at the site the easily, safely, and quickly dispensed solution will have excellent fire resistance due to the large amount of silicates in the carrier solution, a good expansion ratio due to the foaming properties of hydrocarbon gases, a stable, solid, and long-lasting structure due to the carrier material, with inflammability by the optimal amount of inert gas dissolved in the solution and mixed in the gas phase, which fire insulating foam is more efficient compared to traditional insulating foams.

BRIEF SUMMARY OF THE INVENTION

In accordance with the set aim, the invention relates to an alkaline post-foaming composition for protection against fire and/or heat. The composition has a propellant ingredient of inert gas 0.5-6% by weight, with an alkali and/or alkaline earth metal silicate as a fire-resistant component to protect against fire and/or heat. The composition also has less than 75% by weight of a solvent medium, such as water. A booster gas or gas mixture component of the propellant gas that contains aliphatic hydrocarbons in addition to the inert gas, with an atmospheric boiling point under 20° C. and vapor pressure at 20° C. between 1-5 bar (abs) is added, in the amount of 0.1-10% by weight. The composition contains a carrier material, 0.5 to 20% by weight, composed of: fatty acids, fatty alcohols, or their salts; esters; aldehydes; and/or amides thereof. The carrier is suitable for the capture of at least a portion of propellant gas or mixture of gases, and furthermore the composition is supplemented with up to 18% by weight of foam enhancement component, made of organic or inorganic soap-forming base. The organic soap-forming base of foam enhancement component includes triethanolamine, diethanolamine, monoethanolamine, morpholine, iso-propanol amine, amino methyl propanol, and/or aminomethyl-propanediol, and the inorganic soap-forming base of foam enhancement component includes sodium hydroxide and/or potassium hydroxide.

In another embodiment of the invention, the aliphatic hydrocarbon gas component of the booster gas may contain a component selected from the group consisting of propane, n-propane, isopropane, butane, n-butane, isobutane, pentane, n-pentane, isopentane, and neopentane.

For the post foaming composition, it is beneficial when carrier is selected from the group consisting of stearic acid, myristic, palmitic, lauric acid, other C4-C36 atom fatty acids, fatty alcohols, and fatty acids of animal or vegetable origins, or their related compounds. Further, the inert gas used for propellant gas component can be argon, nitrogen, helium, and/or xenon.

According to one possible embodiment, the fire-resistant component is made of an aqueous solution of at least one of sodium silicate, potassium silicate, aluminum silicate, magnesium silicate, lithium silicate, and cesium silicate. In an embodiment of the post-foaming composition, the foam enhancement component is at least partially made of surfactants, wetting agents, and/or viscosity enhancing substances.

In an embodiment, the surfactants of the foam enhancement component include of at least one of polyethylene glycol, polypropylene glycol, polyethylene glycol stearate, alkyl polyglycosides, sodium stearate, potassium stearate, polyethylene glycol alkyl ether, octaetylene glycol monododecyl ether, pentaethylene glycol monododecyl ether, polypropylene glycol alkyl ether, glucoside alkyl ethers, decyl glucoside, lauryl glucoside, octyl glucoside, polyethylene glycol octyl phenyl ethers, polyethylene glycol alkyl ethers, glyceryl laurate, polysorbate, cocamide monoethanolamine (MEA), cocamide diethanolamine (DEA), cocamide dodecyl oxide, polyethoxylated tallow amine, polyoxyethylene, and stearyl ether.

In a further embodiment, the wetting agent of the foam enhancement component is made of at least one of glycerol, ethylene glycol, propylene glycol, butylene glycol, and sorbitol. A viscosity enhancing substance of the foam enhancement component material includes at least one of carboxymethyl cellulose, hydroxyethyl cellulose, hydroxypropyl cellulose, hydroxypropyl methyl cellulose, hydroxyethyl cellulose, methyl cellulose, ethyl cellulose, hydroxybutyl methyl cellulose, alkyl glycol, polyacrylic acid, alkyl-modified cellulosic polymer, guar gum, xanthan gum, agar, alginic acid, gum arabic, carrageenan, and starch.

The post-foaming composition according to the invention offers numerous advantages. The most important of them is that, despite the composition being produced of readily available, reasonably priced components, forming a high consistency and well-adherent foam (including on vertical surfaces), and by the effect of the given molecular structure of carrier material and physical characteristics of fire-resistant component and propellant gases, the composition is not combustible, and forms a solid ceramic structure if exposed to heat, maintaining its characteristics up to 810° C. temperature, so that a fire-resistant hard shield covers the object. A further advantage is that the composition is not only useful for firefighting, but also for insulation, and the composition can be used immediately on emergency situations.

A significant advantage is that, in case of a hydrocarbon firefighting scenario, the foam forms a thin layer when sprayed on a burning liquid hydrocarbon, spreading over the area, and having a good adhesion to the hot metal surface. The composition thereby can inhibit combustion beside the sidewall of hydrocarbon reservoirs. Furthermore, on the surface of the liquid hydrocarbon, the composition can also form a protective layer; therefore, the flames cannot devastate the foam.

Another important advantage is that the composition is alkaline, and therefore is not corrosive for ferrous metals, does not attack or solve the material of a metal container, and so the composition can be safely stored for a prolonged period. The foam is also environmentally friendly, and easy to wipe off after usage. Additional environmental advantages of the composition are that it is biodegradable, so in the case of exterior applications, such as on forest fires, the composition does not pollute the environment after application The amount of hydrocarbons introduced into the material can be slightly decreased, in which case a very high fire-resistant foam is generated with little expansion ratio, which is different from conventional inert gas-propelled foams. In the long-time stable structure of the carrier material (up to several days), the effect of the silicate additive continuously provides fire-resistant and insulating properties, as well as after total dehydration.

A further advantage of the invention is that the insulating foam that is already dispensed has water vapor emission upon contact with fire, due to silicate in solution, greatly reducing the amount of foam destruction. It is proved experimentally that insulation characteristics, durability, and fire resistance of the foam obtained is far superior to the conventional foams.

Another main advantage of the invention is that the foam obtained, contrary to conventional foams, does not show any water drop even after one week of storage, due to the stable structure of the carrier material. For this reason, it seems to appropriate for extinguishing such boiling liquids, which are in a serious risk of boiling over due to water precipitation from the foam.

In the case of use for thermal insulation, it is a significant advantage that the composition adheres well to vertical surfaces as much as 10 cm layer thickness, and does not slip off. Using an additional fire-resistant component, the durability of foam still reaches as much as 6-12 hours, despite the lower ratio of carrier component. Some compositions achieve unlimited durability, which means that the compositions keep the volume until total dehydration, after which an extremely durable structure remains, similar to a sea-sponge, with soft chalk-like consistency. It carries a further advantage, in that the composition provides a long-time protection after use.

Economic benefits can be evaluated as to the fire-retardant effect of the composition, which is superior with the ability to protect interior and exterior values, natural environment, and vegetation. After the defense is completed, lower minor restoration costs will emerge, compared to the known fire extinguishant materials.

DETAILED DESCRIPTION OF THE INVENTION

The mechanism of action of the post-foaming composition according to the invention is as follows. Inert and hydrocarbon gases, such as propellant gases, maintain a pressure in the bottle to ensure that the composition can be dispensed to the intended destination. The carrier releases soluble hydrocarbon gases and the water drops dissolve inert gases, so the liquid is inflated and creates upstanding foam. This foam maintains the texture and water content up to 6-24 hours, depending on the ratio of the fire-resistant component. As heat reaches the foam, the heat-resistant silicate component becomes activated. Strong heat causes evaporation of the moisture of the carrier, and then the bound water of the silicates evaporates from the foam, with a honeycomb-structure left behind which is a good thermal insulator and is able to protect the object. Above approximately 350° C., a ceramic protective layer forms, while the water content of the foam inside the foam migrates outwards towards the dry crust. For this reason, the crust thickens quickly, and the inside of the foam will be emptied. The crust shields up to 810° C.

The inert gas contents of propellant gases are responsible for the inflammability of the gas mixture, and so the hydrocarbon gas dissolved in the foam material and left in the bottle could not reach a flammable concentration. By filling additional inert gas in the bottle, a large part of the combustible gas will dissolve, and the composition of the gaseous mixture left in the bottle will be formed based on the partial pressures. The post-foaming composition of the invention is well suited against fire of solid objects, as well as hydrocarbon tank fires, due to the mechanism of action of the hydrocarbon gas-inert gas mixture in the composition.

Hereinafter examples of post-foaming compositions of this invention described in detail. It should be noted that the disclosed compositions do not take up all the possible components, but their related compounds in the respective component shown include substantially the same effects in the compositions.

By the preparation of the foam composition, firstly an aqueous solution is made of fatty acids or fatty alcohols and their salts, esters, or aldehydes, with amides used as a carrier. During dissolution of the carrier material, the water is heated to the melting point of the carrier, and the solution is made by saponification and hydrolysis. For this, both the well-known soap-cooking alkalis (NaOH, KOH) or other soap-forming material (such as Triethanolamine) can be used. After this, the fire-resistant silicate additive can be dissolved in the prepared soap solution. The solution is cooled, thickening to become gelatinous in consistency, which may be gelled further as needed with the known thickening agents of the industry (such as sodium carboxyl-methyl cellulose, xanthan gum, and other similar agents). The foaming and water drop properties of the composition may be slightly improved further, such as by the addition of a small amount of surfactant material (such as polyethylene glycol).

Example 1

In the given composition, 170 g of water is heated to over 70° C., with 22 g of stearic acid acting as a carrier. Ten g of triethanolamine, a soap-forming organic base of foam enhancement, was added, and heating was discontinued after the stearic acid dissolved. Subsequently, 4 g of carboxymethyl cellulose, a viscosity enhancement of foam enhancement, was admixed. The solution is cooled down to the temperature near 0° C. and diluted by adding 100 g ice. Then, 4 g of polyethylene glycol stearate and 12 g of polyethylene glycol powder was added to the cooled solution as a surfactant foam enhancement ingredient, and is agitated vigorously while a uniform white mass is formed.

Then, depending on the desired degree of fire resistance, up to 100 g, in this case 70 g, of sodium silicate solution was added with vigorous stirring to the mass obtained. Then, to avoid further thickening, 155 g of ice and/or water was added, and the mixture was maintained near 0° C. temperature. Finally, after 30 minutes, some more water added is thin the composition to reach flowable consistency. The obtained liquid mixture was then filled into a pressure-resistant bottle equipped with a valve, which was evacuated below 0.05 bar previously, and then sealed.

After the bottle is filled with the specific mixture, 5 g per kilogram of isobutane as a hydrocarbon propellant material ingredient and argon gas as an inert propellant gas was filled over, until the cylinder pressure does exceed the design pressure, but a minimum pressure of 20 bar is reached. The mixture is shaken well and thus brought the finished composition in a ready for use state. By spreading over the specific composition, if applied on a wood block, a 2 cm thick layer of foam provided sufficient protection against direct gasoline fire even after 9 minutes.

Example 2

The composition is prepared of cooking oil, frying fat triglycerides, by mixing 330 g of used frying oil and 108 g stearic acid as carriers, and the mixture is heated to a temperature above 70° C., the heating and stirring being continued until the stearic acid dissolved. Simultaneously, 266 g of water, 28 g of potassium hydroxide, and 17 g of sodium hydroxide as an inorganic soap-forming base of foam enhancement ingredient, were charged into a vessel made of suitable material, and heated to about 80° C., in addition to the continuous mixing of the components. Then the two mixtures are combined and uniformly mixed. Subsequently, 560 g of sodium silicate solution as a fire-resistant ingredient, and 3200 g of water was added with vigorous stirring. The resulting low viscosity solution was cooled down to a temperature of about 5° C.

The obtained liquid mixture was then filled into a pressure-resistant bottle equipped with a valve, which was evacuated below 0.05 bar previously, and then sealed. After the bottle is filled to two-thirds with the specific mixture, 20 g per kilogram of isobutane as a hydrocarbon propellant material ingredient and argon gas as an inert propellant gas was filled over, until the cylinder pressure does not exceed the design pressure, but a minimum pressure of 20 bar is reached.

The mixture is shaken well, and the finished composition is ready for use. After spreading over the specific composition, the composite solidified, depending on the ambient temperature. According to the fire resistance, the composition reached a lower level compared to that of Example 1.

Example 3

In another composition, 9 grams of cetyl stearyl alcohol (C14-C16), and 6 grams of myristic acid as a carrier, were mixed with 100 g of water and heated above 56° C. until the alcohol melted and formed an oily layer on the water surface. Then, with continued stirring, triethanolamine as an organic soap-forming base was added until the oily layer completely dissolved; in one example, 8 grams of triethanolamine were used. Then, 3 grams of polyethylene glycol stearate as a surfactant, and 50 g of sodium silicate solution as fire-resistant component, were mixed, and then approximately 1 gram of methyl cellulose as a viscosity-increasing additive was added and the solution was well mixed.

The obtained liquid mixture was then cooled down and filled into a pressure-resistant bottle equipped with a valve, which was evacuated below 0.05 bar previously, and then sealed. After the bottle is filled to two-thirds with the specific mixture, 10 g per kilogram of isobutane hydrocarbon as a propellant material ingredient and nitrogen gas as an inert propellant gas is filled over, until that the cylinder pressure does not exceed the design pressure, but a minimum pressure of 20 bar is reached.

The finished post-foaming composition was then ready for use; after application, the composition had an expansion ratio of about 4, forming a highly viscous, stable layer and adhered to surfaces up to about 1 cm thick layer. Fire resistance was excellent and unchanged even in direct flame. The foam material floated well on hydrocarbon fluids (such as petrol) surface, and not dissolved therein.

Example 4

In another embodiment, about 20 grams of lauric acid as a carrier were mixed in 200 g of water, and then heated above 60° C., with 2 to 3 g of potassium hydroxide mixed as inorganic soap-forming base until the oily layer was dissolved. Then, 10 grams of polyethylene glycol stearate as a surfactant was mixed together with 100 g of sodium silicate solution as a fire-resistant component, and then 4 grams of methyl cellulose and 15 grams of xanthan gum as viscosity-increasing additives was added to the solution and well mixed.

The obtained liquid mixture was then cooled down and filled into a pressure-resistant bottle equipped with a valve, which was evacuated below 0.05 bar previously, and then sealed. After the bottle was filled to two-thirds with the specific mixture, 10 g per kilogram of propane as a hydrocarbon propellant material ingredient and argon gas as an inert propellant gas was filled over, until that the cylinder pressure does not exceed the design pressure, but a minimum pressure of 20 bar is reached.

After application, the specific composition was completely hardened, suitable to cut with a knife, and of a springy consistency, with excellent fire-retardant properties. The density was about 0.3 g/cm$^3$. The foam material floated well on hydrocarbon fluid (such as petrol) surfaces, and not dissolved therein.

Another sample of the resulting liquid mixture was further diluted with 500 g water per kilogram of base material and filled to a bottle identically to the first sample. The mixture was shaken well and thus brought the finished composition ready for use. After spreading of the specific composition, it was found that after application of the composition it was similar to whipped cream in consistency and had excellent fire-retardant properties. The foam material floated well on hydrocarbon fluid (such as petrol) surfaces, and not dissolved therein.

Example 5

In another embodiment, about 10 g cetyl-stearyl alcohol (C14-C16) and 10 g of magnesium stearate as a carrier were mixed into 200 g of water and then heated above 80° C. Then, 2-4 g of potassium hydroxide as an inorganic soap-forming base foam improvement ingredient were mixed until the carrier is completely dissolved. Then, about 100 g of sodium silicate as a fire-resistant ingredient and 5 g of xanthan gum as a viscosity enhancer were mixed in, and the solution was cooled down and thinned with about 50 g of ice.

The obtained liquid mixture was then filled into a pressure-resistant bottle equipped with a valve, which was evacuated below 0.05 bar previously, and then sealed. After the bottle was filled to two-thirds with the specific mixture, 10 g per kilogram of propane as a hydrocarbon propellant material ingredient and argon gas as an inert propellant gas were filled over, until the cylinder pressure does not exceed the design pressure, but a minimum pressure of 20 bar reached.

The mixture was shaken well and, thus, brought the finished composition ready for use. After spreading over the specific composition, a thick, creamy foam was generated, with an expansion ratio of about 10. The flame resistance of the foam was also very good. The foam material floated well on hydrocarbon fluid (such as petrol) surfaces, and not dissolved therein.

Example 6

In another example, about 21 g of stearic acid methyl ester as a carrier was added to 137 g of water and heated above about 60° C. Then, the carrier is melted and forms an oily layer on the liquid surface. Then, 2-3 g of potassium hydroxide as an inorganic soap-forming base is mixed into the hot liquid, while the carrier is completely dissolved. Then, 73 g sodium silicate as a fire-resistant component was added and stirred well.

The solution suddenly thickened, so 150 g of ice and water was added, until it is completely cooled. The liquid was mushy in texture. The obtained liquid mixture was then filled into a pressure-resistant bottle equipped with a valve, which was evacuated below 0.05 bar previously, and then sealed. After the bottle is filled to two-thirds with the specific mixture, 20 g per kilogram of isobutane as a hydrocarbon propellant material ingredient and argon gas as an inert propellant gas was filled over, until the cylinder pressure does not exceed the design pressure, but a minimum pressure of 20 bar is reached.

The mixture was shaken well and thus brought the finished composition ready for use. A thick, creamy foam was generated after application, with an expansion ratio of about 10. The flame resistance of the foam is good. The foam material floated well on hydrocarbon fluid (such as petrol) surfaces, and not dissolved therein. After application of the foam, it was completely balanced, moderate, and creamy, with the particles included in the solution not being found. The fire resistance and durability of the foam obtained was good.

Example 7

In an embodiment, about 8 g of stearic acid methyl ester and 8 g of cetyl stearyl alcohol as carrier components were added to 165 g of water and heated above about 60° C. Then, the carrier was melted and formed an oily layer on the liquid surface. Then, 2 g of potassium hydroxide as an inorganic soap-forming base were mixed in until the carrier is completely dissolved. Then, 80 g sodium silicate as a fire-resistant component was added and stirred well. The liquid cooled down to a temperature close to 0° C. by adding 122 g of ice and water. Then, 5 g of polyethylene glycol stearate as a surfactant foam enhancement ingredient, 4 g of methyl cellulose, and 25 g of carboxymethyl cellulose solution as viscosity enhancing components were mixed in.

In the first application example of the Example 7 composition, the obtained liquid mixture was then filled into a pressure-resistant bottle equipped with a valve, which was evacuated below 0.05 bar previously, and then sealed. After the bottle was filled to two-thirds with the specific mixture, 60 g per kilogram of isobutane hydrocarbon propellant material ingredient was added.

In the second application example of Example 7 composition, the liquid mixture was filled into a bottle in the same way, and then 20 g per liter of isobutane as a hydrocarbon propellant ingredient was added to the mixture through the filling valve. Finally, further argon gas as an inert propellant gas was filled over, until the cylinder pressure did not exceed the design pressure, but a minimum pressure of 20 bar was reached.

The mixture shaken well and thus brought the finished composition ready for use. A creamy foam was obtained after application of the first application of Example 7, with an expansion ratio of approximately 10. The foam has low fire resistance.

The foam obtained was of a more solid and creamy consistency in the second application of Example 7, with an expansion ratio of approximately 12. The foam had high fire resistance. It was found that, above the optimal hydrocarbon content, all properties of the foam decrease significantly.

The post-foaming composition according to the invention is widely useful in all cases, when a large amount of cost-effective, durable, homogeneous, high expansion ratio, fireproof, and good heat insulating foam should be generated quickly, and utilized against the effects of fire and/or heat for a long period.

What is claimed is:

1. An alkaline post-foaming composition for protection against fire or heat, the composition comprising:

a propellant ingredient of an inert gas of between 0.5% and 6% by weight;

one or more aliphatic hydrocarbons added to the propellant ingredient of between 0.1% and 10% by weight, the one or more aliphatic hydrocarbons having an atmospheric boiling point under 20° C., with a vapor pressure at 20° C. of between 1 and 5 bar;

a fire-resistant component selected from the group consisting of an alkali metal silicate, an alkaline earth metal silicate, and a combination of thereof;

a solvent medium of greater than 0% and less than 75% by weight;

foam enhancement component selected from the group consisting of an organic soap-forming base and an inorganic soap-forming base, the foam enhancing component of greater than 0% and less than 18% by weight; and a carrier material selected from the group consisting of fatty acids, fatty alcohols, salts of fatty alcohols, esters, aldehydes, and amides, the carrier material of between 0.5% and 20% by weight, wherein the carrier material is configured for the capture of at least a portion of propellant gas or mixture of gases.

2. The composition of claim 1, wherein the foam enhancement component is the organic soap-forming base selected from the group consisting of triethanolamine, diethanolamine, monoethanolamine, morpholine, iso-propanol amine, amino methyl propanol, and aminomethyl-propanediol.

3. The composition of claim 1, wherein the foam enhancement component is the inorganic soap-forming base of foam enhancement component consisting of sodium hydroxide and potassium hydroxide.

4. The composition of claim 1, wherein the one or more aliphatic hydrocarbons is selected from the group consisting of propane, n-propane, isopropane, butane, n-butane, isobutane, pentane, n-pentane, isopentane, and neopentane.

5. The composition of claim 1, wherein the carrier material further comprises a component selected from the group consisting of stearic acid, myristic, palmitic, lauric acid, and C4-C36 atom fatty acids.

6. The composition of claim 1, wherein the inert gas is selected from the group consisting of argon, nitrogen, helium, and xenon.

7. The composition of claim 1, wherein the fire-resistant component is made of aqueous solution selected from the group consisting of sodium silicate, potassium silicate, calcium silicate, aluminum silicate, magnesium silicate, lithium silicate, and cesium silicate.

8. The composition of claim 1, wherein the foam enhancement component is at least partially comprised of a component selected from the group consisting of a surfactant, a wetting agent, and a viscosity enhancing substance.

9. The composition of claim 8, wherein the foam enhancement component includes the surfactant selected from the group consisting of polyethylene glycol, polypropylene glycol, polyethylene glycol stearate, alkyl polyglycosides, sodium stearate, potassium stearate, polyethylene glycol alkyl ether, octaetylene glycol monododecyl ether, pentaethylene glycol monododecyl ether, polypropylene glycol alkyl ether, glucoside alkyl ethers, decyl glucoside, lauryl glucoside, octyl glucoside, polyethylene glycol octyl phenyl ethers, polyethylene glycol alkyl ethers, glyceryl laurate, polysorbate, cocamide monoethanolamine, cocamide diethanolamine, cocamide dodecyl oxide, polyethoxylated tallow amine, polyoxyethylene, and stearyl ether.

10. The composition of claim 8, wherein the foam enhancement component includes the wetting agent selected from the group consisting of glycerol, ethylene glycol, propylene glycol, butylene glycol, and sorbitol.

11. The composition of claim 8, wherein the foam enhancement component includes the viscosity enhancing substance selected from the group consisting of carboxymethyl cellulose, hydroxyethyl cellulose, hydroxypropyl cellulose, hydroxypropyl methyl cellulose, hydroxyethyl cellulose, methyl cellulose, ethyl cellulose, hydroxybutyl methyl cellulose, alkyl glycol, polyacrylic acid, alkyl-modified cellulosic polymer, guar gum, xanthan gum, agar, alginic acid, gum arabic, carrageenan, and starch.

* * * * *